US005207011A

United States Patent [19]

Coulthard

[11] Patent Number: 5,207,011

[45] Date of Patent: May 4, 1993

[54] DISPLAY SYSTEM WITH CHANGEABLE DISPLAY ELEMENTS

[75] Inventor: Stephen G. Coulthard, Hayward, Calif.

[73] Assignee: Nu-Age Directories, Penn Valley, Calif.

[21] Appl. No.: 766,118

[22] Filed: Sep. 27, 1991

Related U.S. Application Data

[63] Continuation-in-part of Ser. No. 600,721, Oct. 22, 1990, abandoned.

[51] Int. Cl.[5] ..... G09F 7/12; G09F 13/04

[52] U.S. Cl. ..... 40/594; 40/585; 40/568

[58] Field of Search ..... 40/585, 594, 611, 568, 40/575

[56] References Cited

U.S. PATENT DOCUMENTS

| | | | |
|---|---|---|---|
| 1,289,982 | 12/1918 | Webber | 40/568 |
| 3,660,918 | 5/1972 | Bourseau | 40/585 |
| 3,824,722 | 7/1974 | Maruscak et al. | 40/585 |
| 3,905,139 | 9/1975 | Cooper | 40/585 X |
| 3,924,879 | 12/1975 | Wright | 40/594 X |
| 4,653,209 | 3/1987 | Cobb | 40/568 X |
| 4,654,101 | 3/1987 | Kane . | |
| 4,741,119 | 5/1988 | Baryla | 40/594 |
| 4,991,334 | 2/1991 | Amundsen | 40/568 |

FOREIGN PATENT DOCUMENTS

| | | | |
|---|---|---|---|
| 186979 | 10/1922 | United Kingdom | 40/575 |
| 2117547 | 3/1983 | United Kingdom . | |
| 2231551 | 11/1990 | United Kingdom | 40/594 |

*Primary Examiner*—Kenneth J. Dorner
*Attorney, Agent, or Firm*—Thomas R. Lampe

[57] ABSTRACT

Display apparatus including a translucent display panel, a mat panel having apertures disposed over the display panel, and a plurality of display strips having electrostatic characteristics releasably attachable over the apertures.

5 Claims, 2 Drawing Sheets

DISPLAY SYSTEM WITH CHANGEABLE DISPLAY ELEMENTS

This is a continuation-in-part of U.S. patent application Ser. No. 07/600,721, filed Oct. 22, 1990 now abandoned.

TECHNICAL FIELD

This invention relates to a display system with changeable display elements More particularly, the invention relates to display apparatus particularly applicable to providing information to an observer, such as directory information or menu information.

BACKGROUND ART

The prior art discloses a number of arrangements for displaying directory information and the like. Such systems are generally characterized by their complexity and relatively high expense. Also, prior art systems often are so constructed as to make the job of changing information displayed a difficult, time-consuming, awkward and expensive matter.

A common form of directory display case is that incorporating metal face panels having windows to support plastic holders which in turn hold photo-negatives bearing the indicia to be displayed. Changing the photo-negatives requires removal of the entire holder to replace the photo-negative, either individually through a side opening in the directory display case or in conjunction with the other holders as a unit.

Not only do prior art display case arrangements make the replacement of information strips a difficult matter, prior art directories and the like which incorporate the use of removable strips in association with a lighted back panel often present an unsightly appearance because of the light leak problems which exist about the strips. That is, the observer is not only presented with the lighted strip itself but a display of light located at the strip edges, either wholly or partially about the periphery of the strip. This problem becomes even more aggravated because of the tendency of strip material to warp when heated, as for example, by electric lamps providing the source of light for the directory.

Yet another problem inherent in prior art approaches is the fact that such systems can only accommodate a single strip size.

Representative of prior art approaches are those disclosed in the following patents: U.S. Pat. No. 3,905,139, issued Sep. 16, 1975; U.S. Pat. No. 3,824,722, issued Jul. 23, 1974; U.S. Pat. No. 4,654,101, issued Mar. 31, 1987; and United Kingdom Patent Application Publication No. 2,117,547, published Oct. 12, 1983.

DISCLOSURE OF INVENTION

The display apparatus of the present invention is of relatively simple, low-cost construction as compared with many prior art approaches. In addition, the display apparatus disclosed herein provides for the ready and efficient removal and replacement of information strips employed therein. Also, the present invention is so constructed as to prevent or at least minimize light leak about the display strips. The present system lends itself to use of display strips of different sizes and configurations.

The display apparatus of the present invention includes a translucent display panel having an outer display panel surface.

Mat means is connected to the translucent display panel, said mat means including a mat panel constructed of substantially light impervious material in at least partial registry with the outer display panel surface and disposed adjacent thereto.

The mat panel defines a plurality of apertures spaced from one another and permitting the passage of light from the translucent display therethrough.

A plurality of display strips provide information to a viewer. The display strips are releasably attachable over the apertures. Each display strip includes an outer peripheral portion which is in registry with the mat panel about the periphery of one of the apertures when the display strip is releasably attached over said one aperture and a central portion in registry with said one aperture.

The central portion of each display strip includes translucent indicia for transmitting light emitted from the translucent display panel through said one aperture.

The display strips each comprise a laminate including a photo-negative strip incorporating the translucent indicia and which is substantially opaque about the translucent indicia. A backing strip formed of translucent static cling material is secured to the photo-negative strip in face-to-face relationship therewith by adhesive means such as double-face clear adhesive tape.

Other features, advantages, and objects of the present invention will become apparent with reference to the following description and accompanying drawings.

BEST MODE FOR CARRYING OUT THE INVENTION

Figure 4:
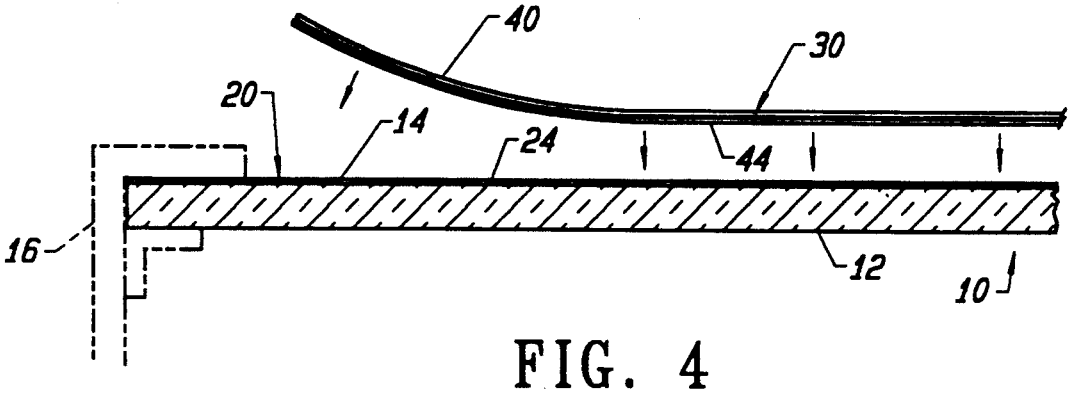
FIG. 4 is an enlarged cross-sectional view illustrating a segment of the apparatus display panel positioned in a display case and a display strip being positioned on the display panel and mat operatively associated therewith.

Referring now to the drawings, display apparatus constructed in accordance with the teachings of the present invention is designated generally by reference numeral 10. The apparatus 10 includes a translucent display panel 12 constructed of a suitable material such as glass or plastic. The display panel 12 has an outer display panel surface 14. The display panel 12 is for mounting, as is conventional, in a display case such as display case 16, a portion of which is shown in FIG. 4 and illustrated by dash lines. Although not illustrated, case 16, as is conventional, has one or more electric light fixtures incorporated therein for illuminating the display panel.

According to the teachings of the present invention a mat is connected to the translucent display panel. In particular, the mat includes an opaque mat panel 20 formed of any suitable opaque material such as plastic sheeting. A suitable adhesive is employed to secure the mat panel in position on the display panel outer surface.

Mat panel 20 defines a plurality of apertures 24 which are spaced from one another and permit the passage of light from the translucent display panel therethrough. The apertures may be formed in the mat panel in any desired fashion such as through use of die-cutting techniques.

Figure 1:
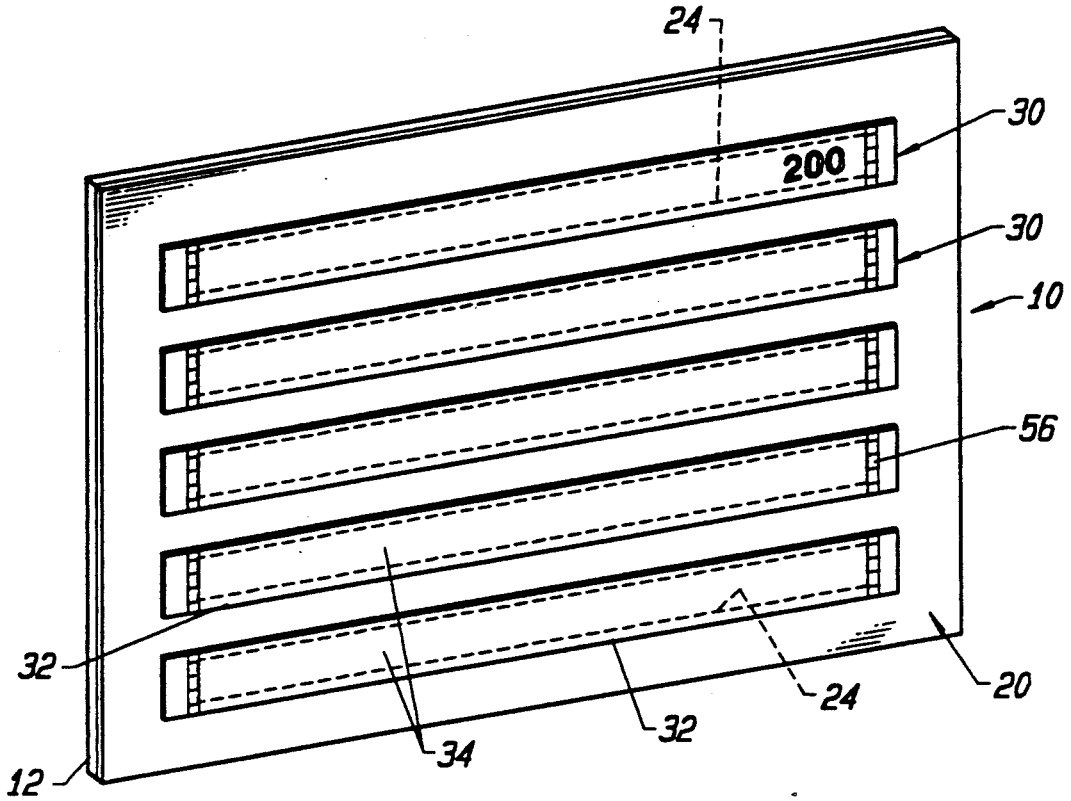
FIG. 1 is a frontal, perspective view of a preferred embodiment of the present invention and illustrating display strips in position.
Figure 2:
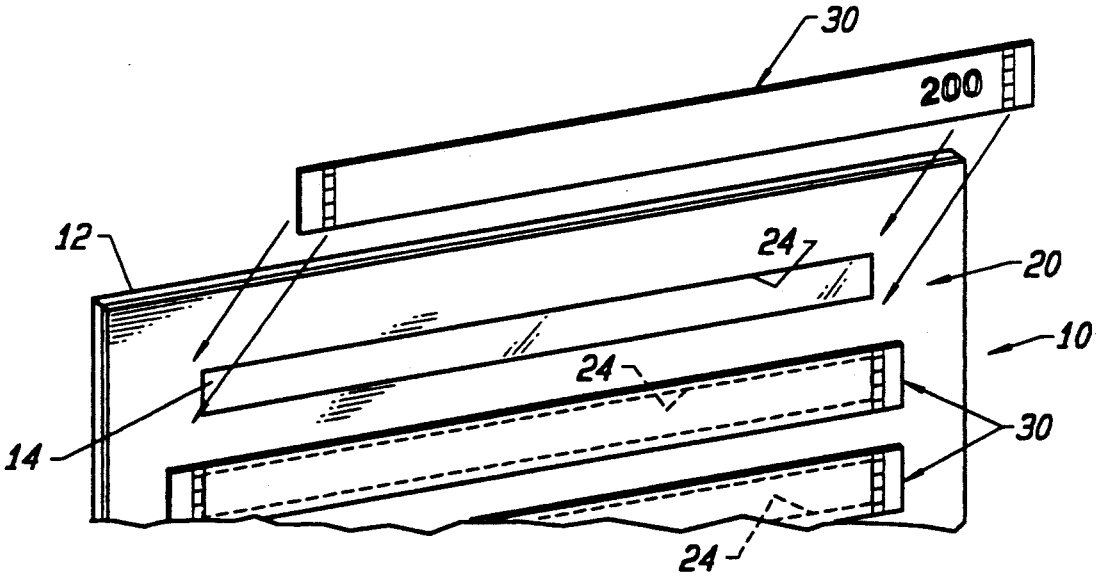
FIG. 2 is a perspective view similar to FIG. 1 but illustrating a portion of the apparatus broken away and a display strip located prior to positioning thereof relative to the display panel means of the invention.
Figure 3:
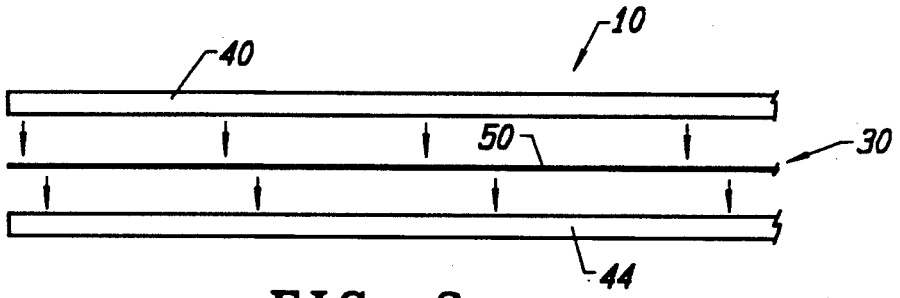
FIG. 3 is a diagrammatic view illustrating the laminate components of a display strip prior to securement together.
Figure 5:
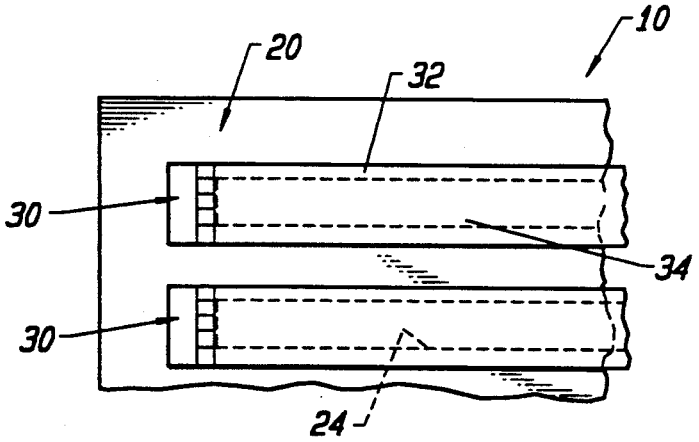
FIG. 5 is an enlarged, fragmentary, frontal view showing operational details of the mat and display strips operatively associated therewith.

A plurality of display strips 30 are releasably attachable to the display panel over the mat apertures 24. Each display strip 30 includes an outer peripheral portion 32 and a central portion 34. When a display strip 30 is in position the central portion 34 is in registry with an aperture 24 and the outer peripheral portion 32 thereof is in registry with the mat panel 20 about the periphery of the associated aperture. The central portion of the display strip includes translucent indicia for transmitting light emitted from the translucent display panel through the aperture with which the particular strip is operatively associated. In FIGS. 1, 2 and 5, in the interest of simplicity, only one of the display strips 30, i.e. the topmost strip, has indicia thereon. In this case, the indicia is the name "The John Smith Company" located in Room "200".

Each display strip is in the form of a laminate including a photo-negative strip which has been processed in a suitable conventional manner to provide the desired indicia located at the central portion of the display strip. Except for the translucent indicia the photo-negative strip is substantially opaque.

Another component of the display strip laminate is a backing strip 44 formed of translucent static cling (electrostatic) material, such as PENSTICK Static Cling Vinyl manufactured by Molco Inc., Waymart, Pa. The photonegative strip 40 and the backing strip 44 are in face-to-face relationship, being secured together by a suitable adhesive means such as double-face clear adhesive tape 50. The double-back adhesive tape 50 may be replaced by a layer of adhesive; however, it has been found that this latter approach is less desirable because of the greater likelihood of developing air bubbles when forming the laminate.

Applying the display strips to the display panel outer surface and mat panel is simplicity itself. The display strips are simply pushed into position and into engagement with the outer surface 14 and mat panel. The electrostatic character of the backing strip will maintain the display strip in position. Removal is also facilitated.

In the present arrangement, the display strips are elongated in shape and incorporate means for aligning the strips in position relative to the mat panel. In particular, the strips incorporate dashed guidelines 56 (shown in greatly exaggerated fashion in the drawings) which are placed just outside the confines of the apertures 24 to guide the strips into proper placement and alignment.

It will be appreciated that the character of the mat panel, and more particularly the size and shape of the apertures 24 therein, determine the size and shape of the display strips being utilized when practicing the invention. The mat panel may be cut to provide apertures of greater or lesser thickness and/or width. This provides a degree of flexibility not found in conventional display systems. The mat and display strips of the present invention are readily adapted for retrofitting to an existing display panel.

I claim:

1. Display apparatus comprising, in combination:

a translucent display panel having an outer display panel surface;

mat means connected to said translucent display panel, said mat means including a mat panel constructed of substantially light impervious material in at least partial registry with said outer display panel surface and disposed adjacent thereto, said mat panel defining a plurality of apertures spaced from one another and permitting the passage of light from said translucent display panel therethrough; and a plurality of display strips providing information to a viewer, said display strips being releasably attachable over said apertures, each said display strip including an outer peripheral portion which is in registry with the mat panel about the periphery of one of said apertures when said display strip is releasably attached over one aperture and a central portion in registry with said one aperture, said central portion of said display strip including translucent indicia for transmitting light emitted from said translucent display panel through said one aperture, said display strips being elongated and including means for aligning said strips relative to said mat means, said aligning means comprising a line formed on each strip adjacent an end thereof where said outer peripheral portion and central portion meet.

2. The display apparatus according to claim 1 wherein said display strips each comprise a laminate including a photo-negative strip incorporating said translucent indicia and substantially opaque about said translucent indicia, a backing strip formed of translucent static cling material, and adhesive means for securing said photo-negative strip and said backing strip in face-to-face relationship.

3. The display apparatus according to claim 2 wherein said adhesive means comprises double-face clear adhesive tape.

4. The display apparatus according to claim 2 wherein said translucent static cling material is vinyl sheeting.

5. The display apparatus according to claim 1 wherein said mat means includes adhesive for securing said mat panel to said display panel.

* * * * *